US010421022B2

(12) United States Patent
Muraki et al.

(10) Patent No.: US 10,421,022 B2
(45) Date of Patent: Sep. 24, 2019

(54) DETACHABLE STRUCTURE OF TOY

(71) Applicant: TOMY COMPANY, LTD., Tokyo (JP)

(72) Inventors: Makoto Muraki, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/939,442

(22) Filed: Mar. 29, 2018

(65) Prior Publication Data

US 2019/0111353 A1 Apr. 18, 2019

(30) Foreign Application Priority Data

Oct. 17, 2017 (JP) ..... 2017-201196

(51) Int. Cl.
*A63H 1/04* (2006.01)
*A63F 9/16* (2006.01)

(52) U.S. Cl.
CPC . *A63H 1/04* (2013.01); *A63F 9/16* (2013.01)

(58) Field of Classification Search
CPC ... A63H 1/02; A63H 1/04; A63H 1/00; A63H 1/18; A63H 1/16; A63F 9/16; A63B 67/16; A63B 67/165
USPC ... 446/4, 256, 257, 258, 259, 260, 261, 262, 446/263
See application file for complete search history.

(56) References Cited

U.S. PATENT DOCUMENTS 8,210,895 B2 7/2012 Bertrand et al.
2002/0046483 A1* 4/2002 Snell ..... A01M 1/026 43/131

FOREIGN PATENT DOCUMENTS

| | | |
|---|---|---|
| EP | 3 009 174 | 4/2016 |
| EP | 3 195 911 | 7/2017 |
| JP | 4580289 | 1/2007 |

OTHER PUBLICATIONS

Extended European Search Report dated Oct. 15, 2018 in Application No. 18164782.7.
J-Plat Pat English Abstract for Japanese Patent Application Publication No. 2007-006957, published Jan. 18, 2007.

* cited by examiner

*Primary Examiner* — Vishu K Mendiratta
(74) *Attorney, Agent, or Firm* — Staas & Halsey LLP

(57) ABSTRACT

A detachable structure includes a toy and a detaching tool. The toy comprises a first part and a second part engaged with the first part. The detaching tool comprises a presser and elastic holders with holding parts that are at any one of a holding position and a holding releasable position. The first part is elastic and comprises an elastic engaging hook that is at any one of an engaged position and an engagement releasing position. The second part engages with the first part when the second part is brought to the first part in a certain direction so that the second part slidably contacts the first part to move the elastic engaging hook to the engagement releasing position and then further to the engaged position.

4 Claims, 13 Drawing Sheets

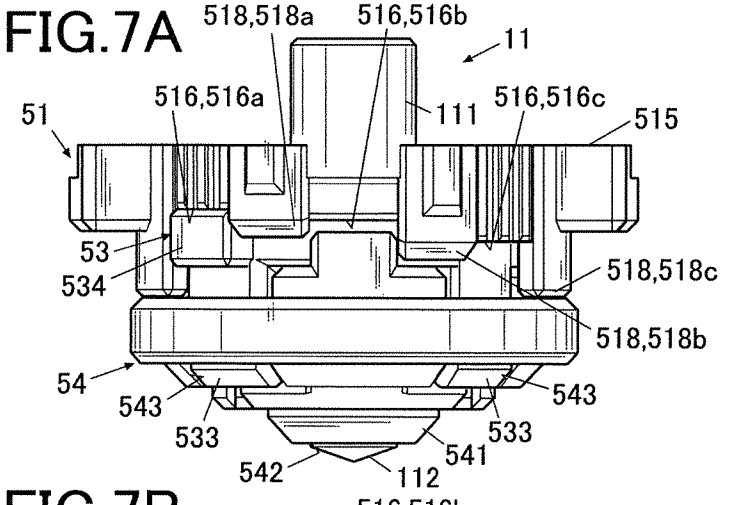
FIG.7A
FIG.7B
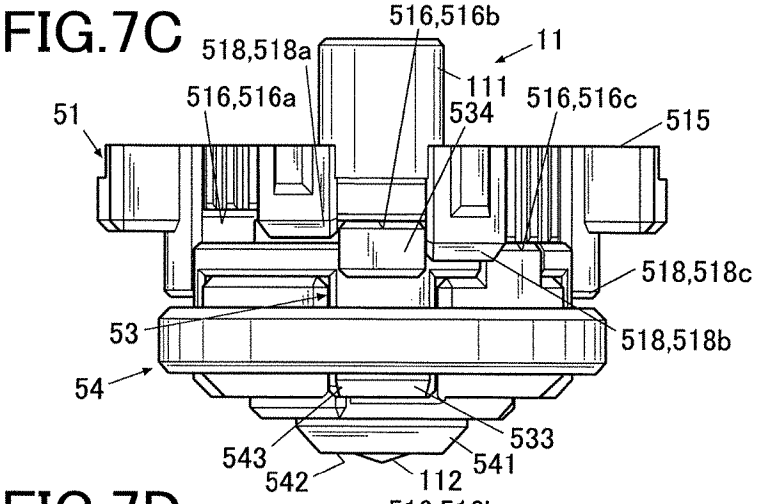
FIG.7C
FIG.7D

DETACHABLE STRUCTURE OF TOY

BACKGROUND OF THE INVENTION

1. Field of the Invention

The present invention relates to a detachable structure of a toy.

2. Description of Related Art

A toy that has been known in the art has an engaging structure between a first part and a second part and includes: the elastic first part including an elastic engaging hook that is at any one of an engaged position and an engagement releasing position; and the second part which engages with the first part when the second part is brought to the first part in a certain direction so that the elastic engaging hook moves slidably on the second part to the engagement releasing position and then further to the engaged position (e.g. see JP 4580289B).

This structure enables readily attaching the first part to the second part since the elastic hook engages with the second part only by bringing the second part to the first part in the certain direction. Such structure is often used for attaching parts of toys.

However, while it is easy to attach a first part to a second part as described above in toys having the above-described part attaching structure, it is difficult to detach the second part from the first part once the second part is attached to the first part. That is, detaching the second part requires a troublesome process that involves moving the hook to the engagement releasing position, keeping the hook at the engagement releasing position, and putting a finger on the second part to remove the second part from the first part while the hook is at the engagement releasing position.

SUMMARY OF THE INVENTION

It is an object of the present invention to provide a detachable structure of a toy which enables readily detaching a part.

According to an aspect of the present invention, a detachable structure includes:

a toy which comprises a first part and a second part engaged with the first part; and a detaching tool which comprises a presser and elastic holders with holding parts that are at any one of a holding position and a holding releasable position, wherein the first part is elastic and comprises an elastic engaging hook that is at any one of an engaged position and an engagement releasing position, wherein the second part engages with the first part when the second part is brought to the first part in a certain direction so that the second part slidably contacts the first part to move the elastic engaging hook to the engagement releasing position and then further to the engaged position, and wherein (i) when the detaching tool is brought to the toy in the certain direction, the presser slidably contacts the engaging hook to move the engaging hook to the engagement releasing position; (ii) subsequently the holding parts slidably contacts the second part to move to the holding position to hold the second part while the engaging hook is at the engagement releasing position; and (iii) then the second part and the detaching tool together are separated from the first part.

Preferably, the detaching tool comprises a guide which leads the presser to slidably contact the engaging hook when the detaching tool is brought to the toy in the certain direction.

With this configuration, it is possible to readily detach the second part from the first part only by bringing the detaching tool to the toy and then separating it away.

Preferably, the elastic engaging hook of the first part is a plurality of elastic engaging hooks, and the presser of the detaching tool is a plurality of pressers that is disposed corresponding to the plurality of elastic engaging hooks.

It is very convenient since engagement of the plurality of elastic engaging hooks can be released at once.

Preferably, the second part has a hole into which the presser is inserted when the detaching tool is brought to the toy in the certain direction, and a receiving part is formed in the hole to engage with the elastic engaging hook.

Since the receiving part is formed in the hole to be engaged with the hook, the hook is prevented from being exposed to the outside.

Preferably, the elastic holders include hooks as the holding parts and surround and hold at least a part of the second part when the second part is detached.

Preferably, the elastic holders hold at least a part of the second part therebetween by an elastic force when the second part is detached.

With these configurations, the second part is reliably held while the second part is being detached.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein:

FIG. 7A to FIG. 7D are side views of a main part of the adjusting member in FIG. 6 D engaged with a step forming member;

DETAILED DESCRIPTION

Hereinafter, an embodiment of the present invention will be described with reference to the drawings. Though various technical limitations which are preferable to perform the present invention are included in the after-mentioned embodiment, the scope of the invention is not limited to the following embodiment and the illustrated examples.

Overall Configuration

Figure 1:
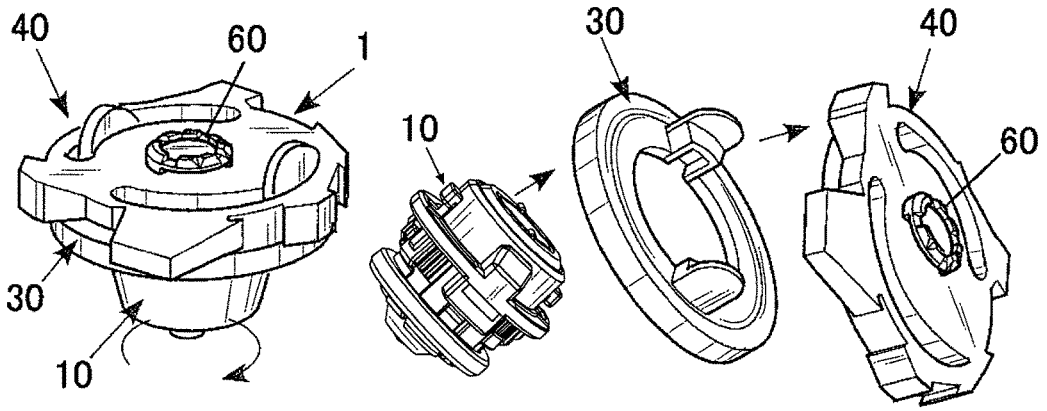
FIG. 1 illustrates how to play a toy top according to an embodiment of the present invention.
Figure 2:
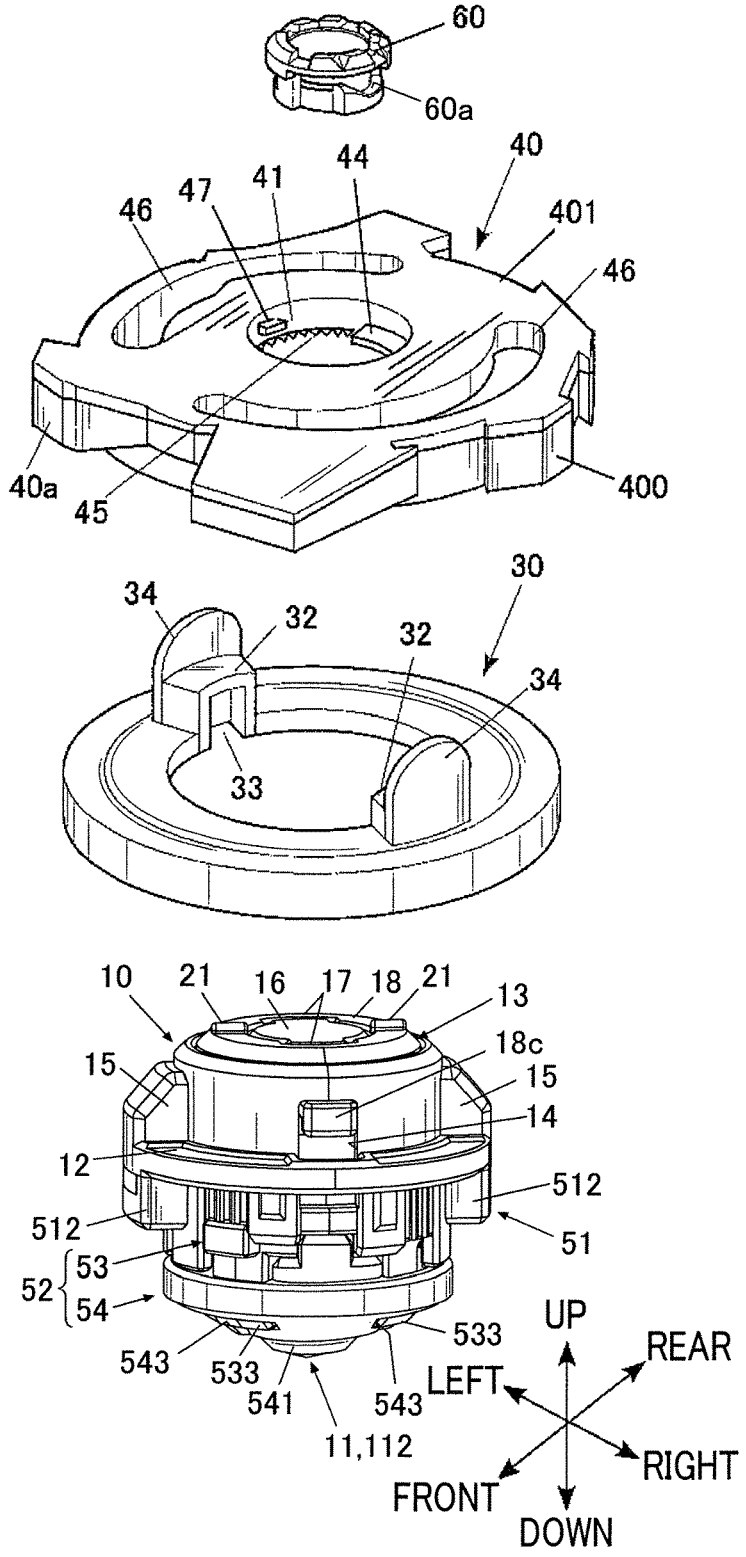
FIG. 2 is an exploded perspective view of the toy top according to the embodiment.
Figure 3:
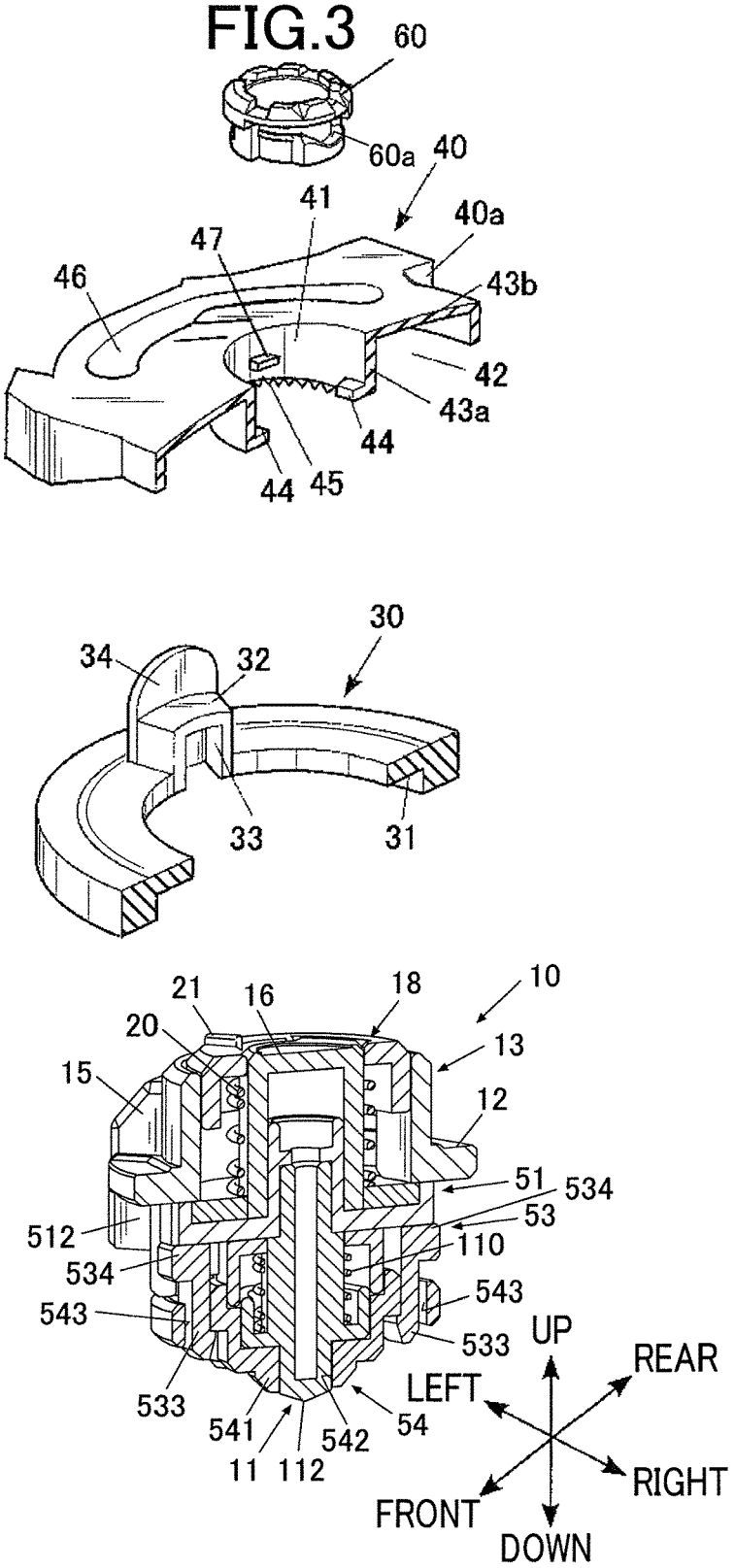
FIG. 3 is an exploded cross-sectional perspective view of the toy top according to the embodiment.

FIG. 1 illustrates how to play a toy top according to an embodiment of the present invention, FIG. 2 is an exploded perspective view of the toy top according to the embodiment, and FIG. 3 is an exploded cross-sectional perspective view of a shaft portion, a body and a performance changing ring of the toy top according to the embodiment. As used herein, the terms up-down, right-left and front-rear refer respectively to the directions as illustrated in FIG. 2 and FIG. 3.

The toy top 1 of this embodiment can be used for so-called battle games. Specifically, the toy top 1 can be used for a battle game which a player wins when an opponent toy top 1 is disassembled as illustrated in the right side of FIG. 1 by an impact force of a collision between the toy tops.

As illustrated in FIG. 2, the toy top 1 includes a shaft portion 10 that constitutes a lower structure to serve as a driver, a performance changing ring 30 and a body 40 that constitute an upper structure as a layer.

Detailed Configuration

1. Shaft Portion 10

Figure 4A:
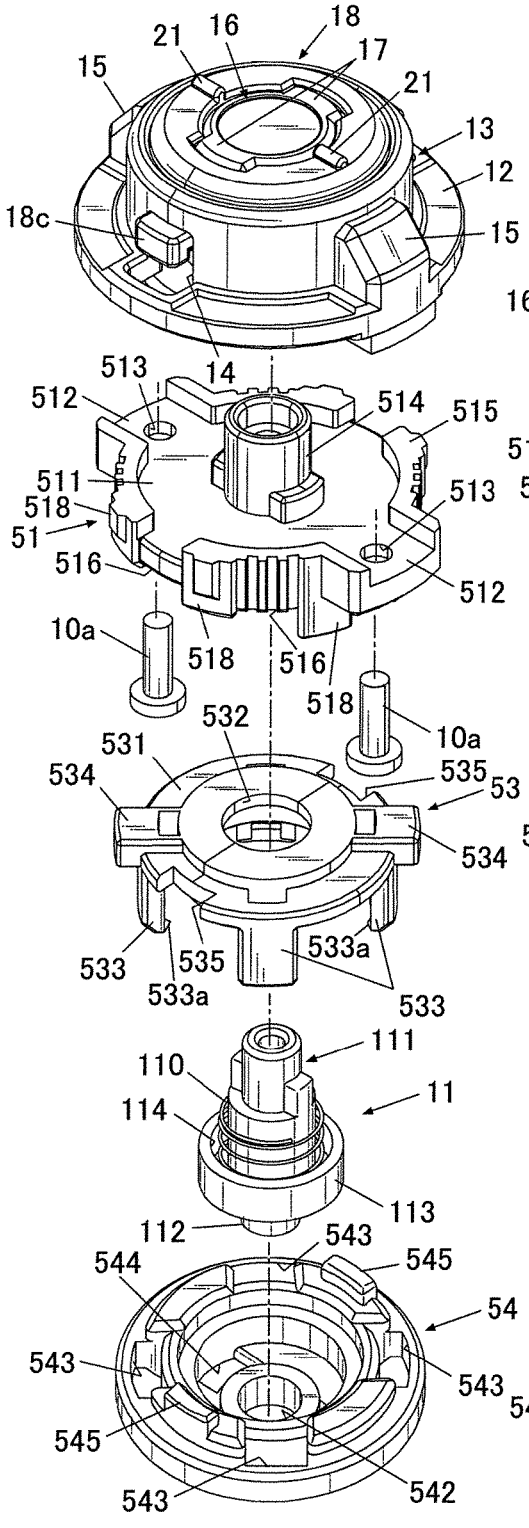
FIG. 4A and FIG. 4B are exploded perspective views of a shaft portion of the toy top according to the embodiment.
Figure 4B:
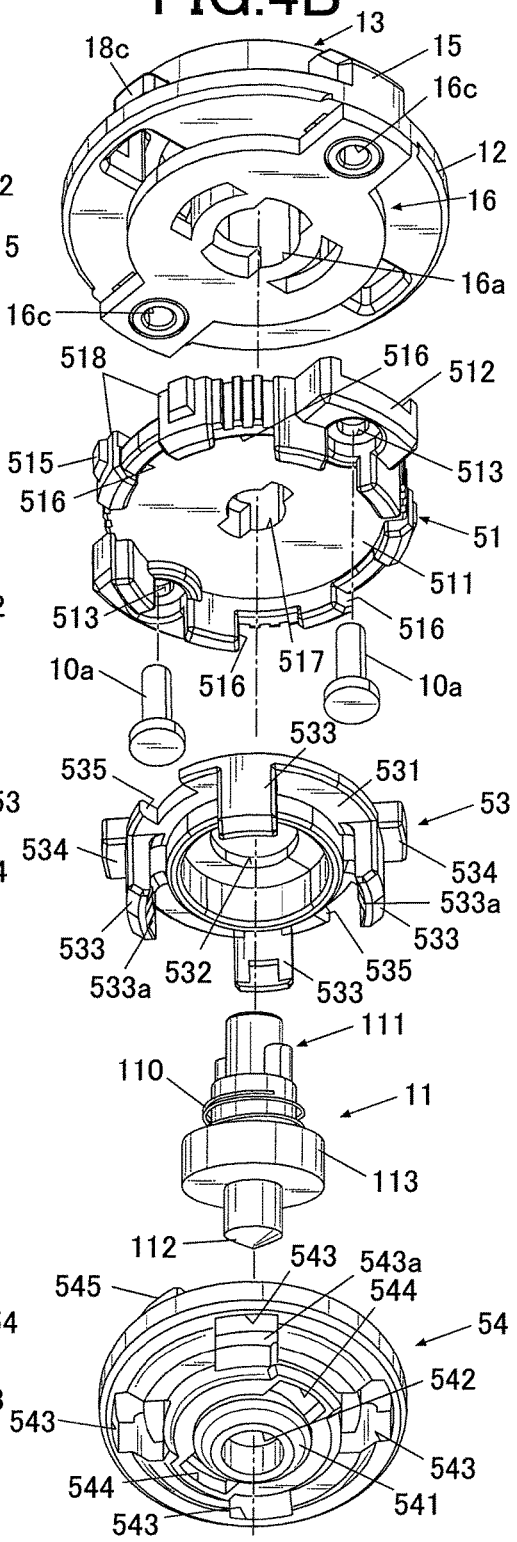

FIG. 4A is an exploded perspective view from above of the shaft portion according to the embodiment, and FIG. 4B is an exploded perspective view from below of the shaft portion according to the embodiment.

As illustrated in FIG. 2 to FIG. 4B, the shaft portion 10 includes a spinning shaft 11 at a lower end, a flange 12 at a center part in the up-down direction, and a cylinder 13 at an upper part.

The flange 12 and the cylinder 13 are integrally formed with each other to constitute an upper shaft portion. Screw holes (not shown) are formed in the flange 12 and the cylinder 13, and a screws 10*a* (see FIG. 4A and FIG. 4B) are inserted in the screw holes of the flange 12 and the cylinder 13 so as to fix the upper shaft portion to a lower shaft portion.

First, the configuration of the upper shaft portion will be described.

In each of the flange 12 and the cylinder 13, two holes 14 are mutually opposed in the right-left direction across the axis (center axis) of the spinning shaft 11 (see FIG. 2 and FIG. 4A).

In the cylinder 13, two protrusions 15 are mutually opposed in the front-rear direction across the axis of the spinning shaft 11. Outer faces of the protrusions 15 are flush with an outer circumferential face of the flange 12.

Figure 5:
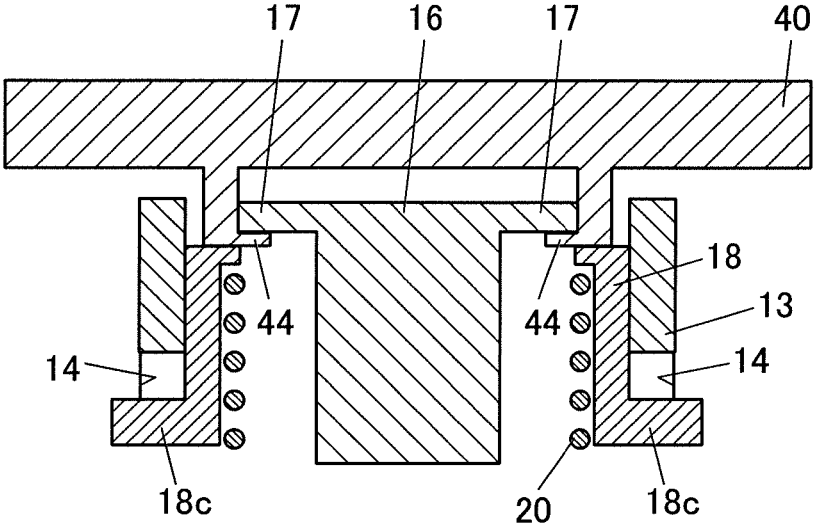
FIG. 5 is a schematic cross-sectional view of an upper shaft portion of the shaft portion of the toy top according to the embodiment, illustrating an assembled engagement thereof.

FIG. 5 is a schematic cross-sectional view of the upper shaft portion, illustrating an assembled engagement thereof.

As illustrated in FIG. 3 and FIG. 5, a cylindrical pillar 16 stands inside the cylinder 13.

An upper end of the cylindrical pillar 16 is higher than an upper end of the cylinder 13. However, the position is not particularly limited. At the upper end of the cylindrical pillar 16, two hooks (engaging parts) 17 protrude outward in the radial direction, which are mutually opposed in the right-left direction across the axis of the spinning shaft 11.

At a lower end of the cylindrical pillar 16 corresponding to the center axis of the spinning shaft 11, a hole 16*a* (see FIG. 4B) is formed. The shape of the hole 16*a* corresponds to the shape of a cylinder 514 of a step forming member 51 (described later), and the cylinder 514 is inserted in the hole 16*a* when the lower shaft portion is attached to the upper shaft portion.

At the lower end of the cylindrical pillar 16 corresponding to the screw holes (not shown) of the flange 12 and the cylinder 13, holes 16*c* are formed. The above-described screws 10*a* are inserted in the screw holes through through holes 513 of the step forming member 51 (described below) and the holes 16*c* so as to fix the lower shaft portion to the upper shaft portion.

The shaft portion 10 also includes a cylindrical pressing member 18 around the cylindrical pillar 16 and inside the cylinder 13.

At a lower end of an outer circumference of the pressing member 18, two legs 18*c* are mutually opposed in the right-left direction across the axis of the spinning shaft 11 as illustrated in FIG. 2 to FIG. 5. The pressing member 18 is biased upward by a spring 20. The pressing member 18 is disposed so that upward movement of the legs 18*c* is restricted by upper edges of the holes 14. In an ordinary engagement, the upper end of the pressing member 18 is located slightly higher than the upper end of the cylinder 13.

On a top upper face of the pressing member 18, two ridges (protrusions) 21 extend in the radial direction, which are mutually opposed in the front-rear direction across the spinning shaft 11.

Next, the configuration of the lower shaft portion will be described.

Figure 6A:
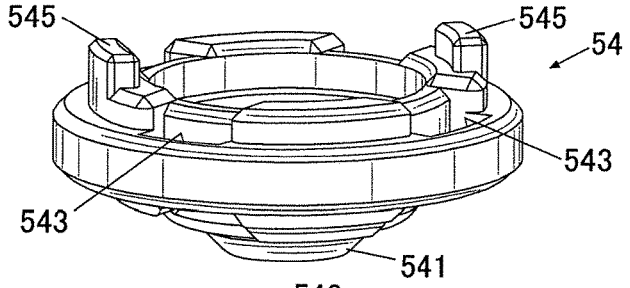
FIG. 6A to FIG. 6C are perspective views of an example of an additional part of the shaft portion of the toy top according to the embodiment.
Figure 6B:
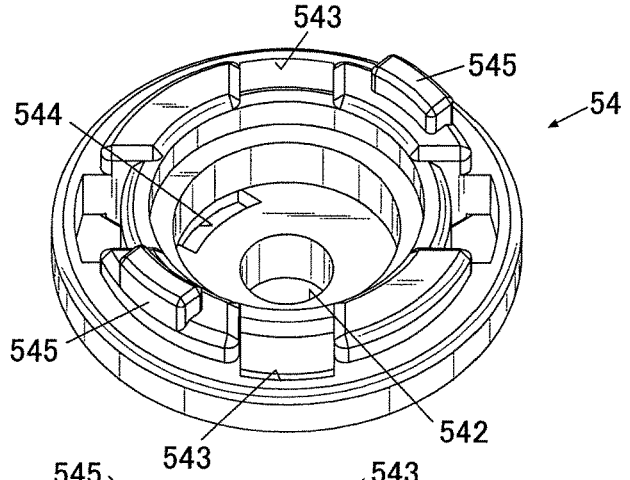
Figure 6C:
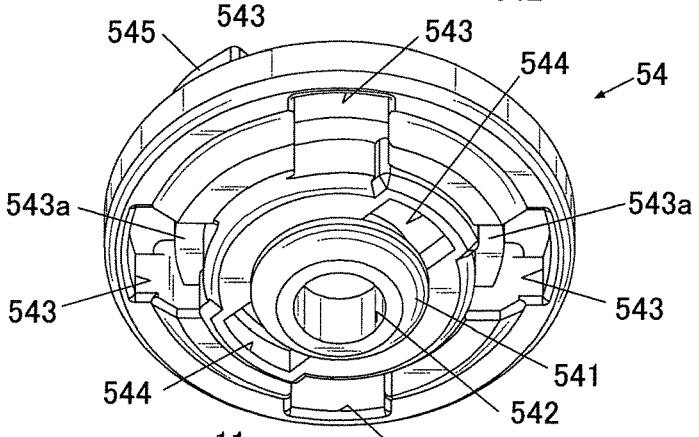
Figure 6D:
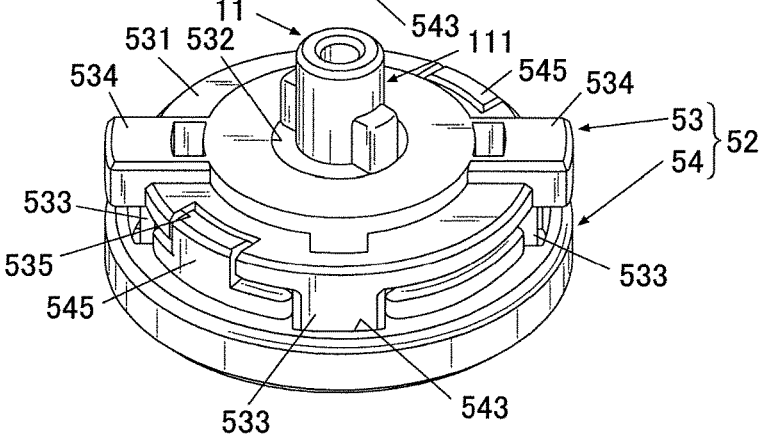
FIG. 6D is a perspective view of an example of an adjusting member that is composed of the additional part in FIG. 6A to FIG. 6C and a supporting part attached thereto.

The lower shaft portion includes the spinning shaft (see FIG. 4A, FIG. 4B and FIG. 6D), the step forming member 51 (see FIG. 4A and FIG. 4B) and an adjusting member 52 (see FIG. 6D).

In the spinning shaft 11, a shaft main body 111 is disposed at an axial center. The shaft main body 111 includes a shaft tip 112 at a lower tip. The embodiment illustrates an example in which the shaft tip 112 has a conical shape (e.g. see FIG. 4B). However, the shaft tip 112 may have any shape such as a simple rod or a rounded tip.

The spinning shaft 11 further includes a flange 113 around the shaft main body 111 near the shaft tip 112.

Around a circumference of shaft main body ill, a coil spring 110 is disposed as a biasing member.

In the embodiment, a groove 114 is formed in an upper face of the flange 113 along the circumference of the shaft main body ill as illustrated in FIG. 4A. An end of the coil spring 110 is disposed in the groove 114.

An upper part of the shaft main body 111 penetrates a supporting part 53 (described later) and is fixed on the step forming member 51. The coil spring 110 as a biasing member is disposed between the flange 113 of the spinning shaft 11 and an upper inner face of the supporting part 53 to bias (press) the supporting part 53 toward the step forming member 51.

The step forming member 51 includes a flat plate part 511 that is formed approximately in a disk shape, and an outer part 515 that is disposed along the outer circumferential edge of the flat plate part 511.

Approximately at a center of the flat plate part 511, a through hole 517 is formed. The through hole 517 is formed in the shape that corresponds to the shape of the upper part of the shaft main body 111 of the spinning shaft 11. The upper part of the shaft main body 111 penetrates the supporting part 53 and is press-fitted in the through hole 517 so that the spinning shaft 11 is fixed to the step forming member 51. The manner of fixing the shaft main body 111 of the spinning shaft 11 to the step forming member 51 is not limited to press-fitting. For example, the spinning shaft may be fixed by a screw or a bolt or by bonding.

In the flat plate part 511, two bumps 512 are mutually opposed in the right-left direction across the through hole 517 corresponding to the protrusions 15 of the upper shaft portion.

In the bumps 512, through holes 513 are formed corresponding to the screw holes of the upper shaft portion, in which screws 10*a* are inserted.

The lower shaft portion including the step forming member 51 is fixed to the upper shaft portion by the screws 10*a* that are inserted in the screw holes of the flange 12 and the cylinder 13 through the through hole 513.

On an upper face of the flat plate part 511, a cylinder 514 protrudes upward corresponding to the through hole 517. As described above, the cylinder 514 is fitted in the hole 16*a* of the cylindrical pillar 16 when the lower shaft portion is attached to the upper shaft portion.

The outer part 515 of the step forming member 51 projects both upward and downward from the flat plate part 511. At the lower projection of the outer part 515, an engaging part is disposed to engage the additional part 54 (described later) with the spinning shaft 11 at different positions in the axis direction.

In the embodiment, the engaging part are constituted by a plurality of recesses 516 (recesses 516*a*, 516*b*, 516*c* in FIG. 7) with different depths in the axis direction of the spinning shaft 11. The recesses 516*a*, 516*b*, 516*c* are arranged around the axis of the spinning shaft 11.

As described later, the recesses 516 (recesses 516*a*, 516*b*, 516*c*) as the engaging part engage with the additional part 54 (in the embodiment, projections 534 of a supporting part 53 that is movable in the axis direction of the spinning shaft 11 integrally with the additional part 54 and that together with the adjusting member 52 constitutes the additional part 54). Each of the recesses 516 has a width capable of engaging with the projections 534.

In the embodiment, two projections 534 are approximately mutually opposed across the axis of the spinning shaft 11, and each pair of recesses 516*a*, 516*b*, 516*c* are approximately mutually opposed across the axis of the spinning shaft 11 corresponding to the two projections 534.

In the embodiment, the projection 534 of the supporting part 53 is engaged with any pair of the recesses 516 (recesses 516*a*, 516*b*, 516*c* in FIG. 7) so that the attachment position in the axis direction of the additional part 54 is changeable.

In the illustrated example, the recesses 516*a* are the deepest in the axis direction of the spinning shaft 11, the recesses 516*c* are the shallowest in the axis direction of the spinning shaft 11, and the recesses 516*b* have an intermediate depth between the recesses 516*a* and the recesses 516*c*.

The shape, the depth in the axis direction of the spinning shaft 11, the number, the position and the like of the recesses 516 in the embodiment are merely an example and may be suitably changed. The step forming member 51 may have any number (step) of recesses with any shape that are located within the engageable range of the projections 534 of the supporting part 53.

In the embodiment, the adjusting member 52 includes the additional part and the supporting part 53 that is movable in the axis direction of the spinning shaft 11 integrally with the additional part.

It is preferred that the additional part is detachable from the shaft portion 10.

When the additional part is detachable, it is preferred that different types of exchangeable additional parts are provided so that the user can freely choose one to be attached to the shaft portion 10.

As described later, the attachment position in the axis direction of the spinning shaft 11 (attachment position in the height direction of the shaft portion 10) of the additional part of the embodiment can be readily changed only by turning it around the axis without detaching it from the shaft portion 10. Since the grounding engagement and the height of the shaft portion 10 are changeable according to change of the attachment position of the additional part, it is possible to readily make various modifications of the toy top. When different detachable additional parts are provided so that the additional part is suitably exchangeable, it is possible to make a wider variety of modifications of the toy top 1.

The embodiment is an example in which two different additional parts, an additional part 54 in FIG. 6A to FIG. 6D and an additional part 57 in FIG. 8A to FIG. 8D are provided, which are detachable from the shaft portion 10 and exchangeable from each other.

In the embodiment, the additional part 54 and the additional part 57 are different from each other only in their lower ends, and FIG. 2, FIG. 3, FIG. 4A and FIG. 4B illustrate only an example in which the additional part 54 is attached to the shaft portion 10.

It is not essential in the embodiment that the additional part is detachable from the shaft portion 10. Further, even when the additional part is detachable, it is not essential that exchangeable different additional parts are provided. For example, only one of the additional parts 54, 57 may be provided. When the additional part 54 or 57 is broken by repetitive use in games or the like, the broken additional part 54 or 57 may be detached and replaced with a new additional part 54 or 57 of the same type.

In the embodiment, the additional part 54 is configured such that the spinning shaft 11 can be inserted from the upper side, and the shaft tip 112 of the spinning shaft 11 can stick out downward. Further, the additional part 54 includes a ring 541 which is disposed to circumferentially surround at least the shaft tip 112 of the spinning shaft 11. The position of the ring 541 surrounding the spinning shaft 11 is changed according to change of the attachment position of the additional part 54. The projected length of the shaft tip 112 of the spinning shaft 11 is thus adjustable, and the ring 541 can contact the ground depending on the degree of projection of the shaft tip 112 of the spinning shaft 11.

The configuration of the additional part 54 will be described in detail referring to FIG. 6A to FIG. 6D.

FIG. 6A is a perspective view from obliquely side of the additional part, FIG. 6B is a perspective view from obliquely above of the additional part, and FIG. 6C is a perspective view from obliquely below of the additional part. Further, FIG. 6D is a perspective view from obliquely above of the adjusting member that is composed of the additional part of FIG. 6A to FIG. 6C and the supporting part attached thereto.

As illustrated in FIG. 4A, FIG. 4B and FIG. 6A to FIG. 6C, the additional part 54 is formed in an approximately bowl or inverted conical overall shape. The additional part 54 is configured such that the spinning shaft 11 can be inserted from the upper side, and the shaft tip 112 or a bottom tip of the spinning shaft 11 can stick out downward.

Specifically, the ring 541 is disposed at a lower end of the additional part 54 to circumferentially surround at least the shaft tip 112 or the bottom tip of the spinning shaft 11. At a center of the ring 541, a through hole 542 is formed so that the shaft tip 112 of the spinning shaft 11 can be projected through the through hole 542.

As described above, the outer diameter of the flange 113 of the spinning shaft 11 is larger than the inner diameter of the through hole 542. Since the flange 113 cannot go through the through hole 542, the spinning shaft 11 is held inside the ring 541 so as not to come off from the additional part 54.

The position of the ring 541 surrounding the spinning shaft 11 is changed according to change of the attachment position of the additional part 54, which makes the degree of projection of the shaft tip 112 of the spinning shaft 11 adjustable. Further, the ring 541 can contact the ground depending on the degree of projection of the shaft tip 112 of the spinning shaft 11.

That is, as the attachment position of the additional part 54 ascends relative to the spinning shaft 11, the shaft tip 112 of the spinning shaft 11 projects accordingly from the through hole 542 (e.g. see FIG. 7A and FIG. 7C). On the contrary, as the attachment position of the additional part 54 to the spinning shaft 11 descends relative to the spinning shaft 11, the position of the ring 541 surrounding the spinning shaft 11 descends (toward a bottom tip of the spinning shaft 11) accordingly. When a lower end of the ring 541 becomes equal to or lower than the shaft tip 112 of the spinning shaft 11 (e.g. see FIG. 7D), the ring 541 contacts the ground as well as or instead of the shaft tip 112 of the spinning shaft 11.

FIG. 6A and the like illustrate an example in which the ring 541 is formed in a tapered shape in a side view, having an outer diameter that decreases toward the bottom tip of the shaft portion 10. However, the shape of the ring 541 is not limited to the illustrated example. By changing the outer shape of the ring 541, it is possible to change the action of the toy top 1 when the ring 541 contacts the ground.

On a bottom of the additional part 54, a plurality of engaging holes 543 surrounds the ring 541.

The engaging holes 543 receive and engage with engaging legs 533 (described later) of the supporting part when the shaft portion 10 is assembled. In the embodiment, four engaging holes 543 are formed at substantially the same intervals so as to be at substantially the same distance in the front, rear, left and right directions from ring 541 in accordance with the number and position of the engaging legs 533 of the supporting part 53.

In the engaging holes 543, steps 543*a* are formed. When the engaging legs 533 are inserted in the supporting part 53, hooks 533*a* at tips of the engaging legs 533 engage with the steps 543*a*.

When the engaging legs 533 of the supporting part 53 are inserted in the engaging holes 543 so that the hooks 533*a* engage with the steps 543*a*, the additional part 54 and the supporting part 53 engages and integrates with each other to form the adjusting member 52.

The shape, number, position and the like of the engaging holes 543 correspond to those of the engaging legs 533 of the supporting part 53 but are not limited to the illustrated example.

In a bottom of the additional part 54, a plurality of engaging holes 544 are formed at a different position from the engaging holes 543. In the embodiment, two engaging holes 544 are approximately mutually opposed across the ring 541.

In the embodiment, the engagement between the additional part 54 and the supporting part 53 is released by inserting nails or jigs into the engaging holes 544 and pulling the additional part 54 downward. The additional part 54 can thus be detached from the shaft portion 10.

The shape, number, position and the like of the engaging holes 544 are not limited to the illustrated example.

The method of detaching the additional part 54 by releasing the engagement between the additional part 54 and the supporting part 53 is not limited to the above-described example, and other jigs and methods may be used instead.

On the upper face of the additional part 54 of the embodiment, protrusions 545 are formed corresponding to recesses 535 (described later) of the supporting part 53.

The embodiment illustrates an example in which two protrusions 545 are approximately mutually opposed across the axis of the spinning shaft 11. However, the shape, number, position and the like of the protrusions 545 are not limited to the illustrated example.

Next, the configuration of the additional part 57 will be described in detail referring to FIG. 8A to FIG. 8D. Unlike FIG. 6D, the spinning shaft 11 is not shown in FIG. 8D.

Figure 8A:
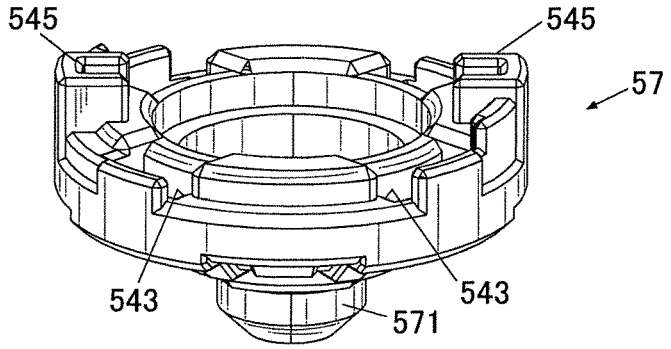
FIG. 8A to FIG. 8C are perspective views of a variation of the additional part of the shaft portion of the toy top according to the embodiment.
Figure 8B:
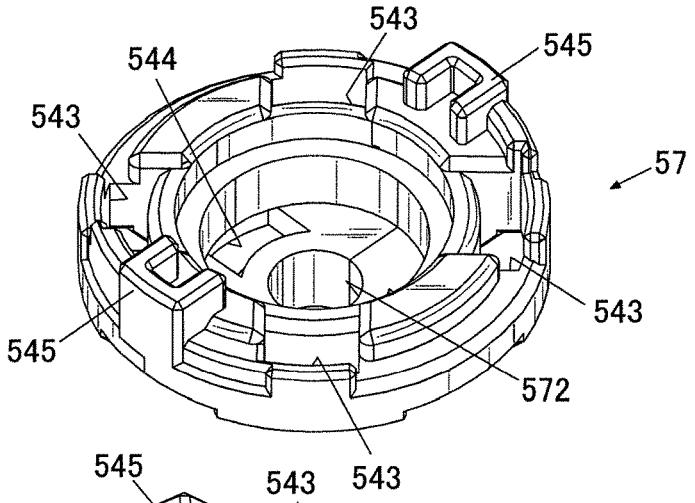
Figure 8C:
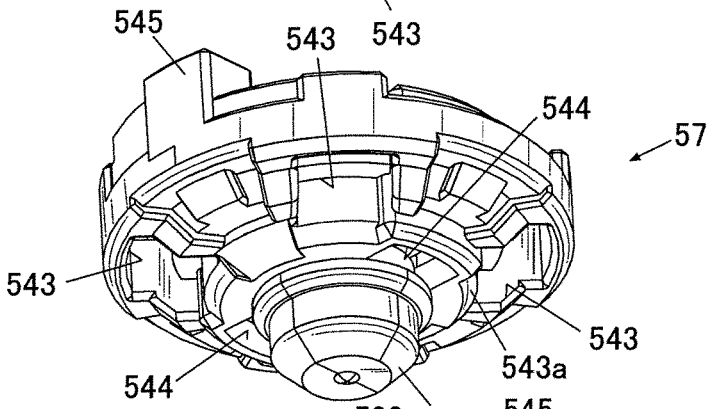
Figure 8D:
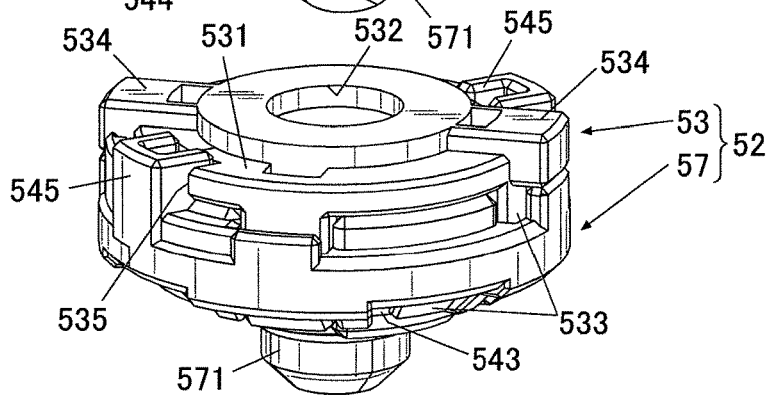
FIG. 8D is a perspective view of an example of the adjusting member composed of the additional part in FIG. 8A to FIG. 8C and the supporting part attached thereto.

FIG. 8A is a perspective view from obliquely side of the additional part, FIG. 8B is a perspective view from obliquely above of the additional part, and FIG. 8C is a perspective view from obliquely below of the additional part. Further, FIG. 8D is a perspective view from obliquely above of the adjusting member that is composed of the additional part in FIG. 8A to FIG. 8C and the supporting part attached thereto.

As illustrated in FIG. 8A to FIG. 8C, the additional part 57 is formed in a bowl or inverted conical overall shape as with the additional part 54, and the spinning shaft 11 can be inserted therein from the upper side.

Different from the additional part 54, the additional part 57 includes a covering part 571 at a lower end, which covers the shaft tip 112 or the bottom tip of the spinning shaft 11 from the lower side to form a new spinning shaft. The shaft tip 112 of the spinning shaft is disposed inside the covering part 571 and is not exposed to the outside.

In the covering part 571, a recess 572 is formed to receive the shaft tip 112 (see FIG. 8B).

The additional part 57 changes the height of the shaft portion 10 according to change of the attachment position thereof.

Figure 9A:
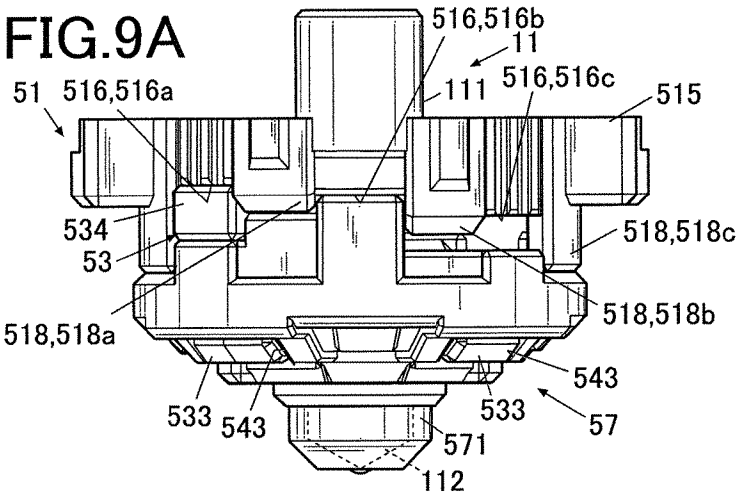
FIG. 9A to FIG. 9D are side views of a main part of the adjusting member in FIG. 8D engaged with the step forming member.

That is, when the additional part 57 is at the highest attachment position to the spinning shaft 11, an inner face of the covering part 571 (i.e. an inner face of the recess 572) is completely or almost in contact with the shaft tip 112 of the spinning shaft 11, and the covering part 571 and the shaft tip 112 are approximately at the same height (e.g. see FIG. 9A). As the attachment position of the additional part 57 to the spinning shaft descends, the inner face of the covering part 571 (inner face of the recess 572) separates away from the shaft tip 112 of the spinning shaft 11 so that the length in the axis direction of the shaft portion 10 increases (see FIG. 9D). In this way, the overall height of the toy top 1 is greater when the outer face of the covering part 571 of the additional part 57 is in contact with the ground than when the shaft tip 112 of the spinning shaft 11 is in contact with the ground. This allows changing the center of gravity of the toy top 1 and thereby changing the action of the toy top 1.

FIG. 8A, FIG. 8C and the like illustrate an example in which the covering part 571 has a tapered shape in a side view, having an outer diameter that decreases toward the bottom tip of the shaft portion 10. However, the shape of the covering part 571 is not limited to the illustrated example. By changing the outer shape of the covering part 571, it is possible to change the action of the toy top 1 when the covering part 571 contacts the ground.

Since the other configuration of the additional part 57 is the same as that of the additional part 54, the same reference signs are denoted to the same parts, and the description thereof is omitted.

The supporting part 53 includes an approximately disk-shaped flat plate part 531, and a through hole 532 through which the spinning shaft 11 is inserted is formed approximately at a center of the flat plate part 531. The supporting part 53 is disposed on the additional part 54 such that an upper part of the shaft main body 111 of the spinning shaft 11 projects upward from the through hole 532, and the flange 113 of the spinning shaft 11 is intervened between the additional part 54 and the supporting part 53.

As described above, the supporting part 53 is biased (pressed) upward (i.e. against the upper shaft portion and the step forming member 51 fixed thereto) by the coil spring 110 that is disposed around the spinning shaft 11.

In the circumferential face of the flat plate part 531 of the supporting part 53, two recesses 535 are approximately mutually opposed across the axis of the spinning shaft 11. The above-described protrusions 545 on the upper face of the additional part 54 are fitted in the recesses 535. This prevents the supporting part 53 and the additional part 54 from moving relative to each other in the spinning direction (circumferential direction of the spinning axis).

The shape, number, position and the like of the recesses 535 correspond to the protrusions 545 of the additional part 54 but are not limited to the illustrated example.

At a lower end of the flat plate part 531 of the supporting part 53, the four engaging legs 533 stand vertically downward.

The engaging legs 533 are disposed corresponding to the engaging holes 543 to engage with the above-descried engaging holes 543 of the additional part.

The engaging legs 533, which are rather elastic, include respective hooks 533*a* that protrude toward the axis (center axis).

To assemble the toy top 1, the engaging legs 533 are inserted into the engaging holes 543 of the additional part 54 to engage the hooks 533*a* with the steps 543*a* of the additional part 54. The engaging legs 533 thus hold the additional part 54 from four directions. As a result, the additional part 54 and the supporting part 53 are engaged with each other to work integrally.

The shape, number, position and the like of the engaging legs 533 correspond to those of the engaging holes 543 of the additional part 54 but are not limited to the illustrated example.

On an upper face of the flat plate part 531 of the supporting part 53, projections 534 are provided as an engaging part that can fit in the recesses 516 (recesses 516*a*, 516*b*, 516*c*) of the shaft portion 10 (step forming member 51 in the embodiment).

In the embodiment, each pair of recesses 516 (recesses 516*a*, 516*b*, 516*c*) are approximately mutually opposed across the axis of the spinning shaft 11 as described above. Corresponding to a pair of recesses 516*a*, 516*b* or 516*c*, two projections 534 are mutually opposed across the axis of the spinning shaft 11.

The shape, number, position and the like of the projections 534 correspond to the recesses 516*a*, 516*b*, 516*c* but are not limited to the illustrated example. For example, the recesses 516 (recesses 516*a*, 516*b*, 516*c*) may not be disposed as a pair that is mutually opposed across the axis of the spinning shaft 11. When a recess 516 (recesses 516*a*, 516*b*, 516*c*) is disposed at either side in the circumference of the step forming member 51, the projection 534 is also disposed only at the same side in the circumference of the supporting part 53.

2. Performance Changing Ring 30

In the embodiment, the performance changing ring 30 is constituted by a flywheel. The performance changing ring 30 has a plate shape. On a bottom face of the performance changing ring 30, an annular step 31 is formed as illustrated in FIG. 3 so that the flange 12 of the shaft portion 10 can be received therein from the lower side. On an upper face of the performance changing ring 30, two upward protrusions 32 are mutually opposed in the right-left direction across the axis of the spinning shaft 11 as illustrated in FIG. 2 and FIG. 3. In lower parts of the protrusions 32, recesses 33 are formed so that the protrusions 15 of the shaft portion 10 can be received therein from the lower side. On the upper face of the performance changing ring 30, tongues 34 extend upward along an outer side of the respective protrusions 32. The tongues 34 protrude higher than the protrusions 32. Instead of or integrally with the flywheel, the performance changing ring 30 may include a protrusion for attacking an opponent toy top 1 or a recess for averting an attack from an opponent toy top 1 on an outer circumferential face.

3. Body 40

The body 40 has a disk shape. As illustrated in FIG. 2, the body 40 includes a base 400 and a transparent cover 401 which has approximately the same shape as the base 400 in a plan view and to cover the body 400.

On an outer circumference of the body 40, an uneven portion 40*a* is formed. Further, at a center of the base 400, a round hole 41 is formed. The transparent cover 401 covers the base 400 except for the round hole 41 and arc slits 46 (described later). On a bottom face of the body 40, an annular recess 42 is formed so that the protrusions of the performance changing ring 30 can be received therein.

At a lower end of an inner circumferential face of an inner circumferential wall 43*a* that defines the annular recess 42, two hooks (engaging parts) 44 protrude inward in the radial direction, which are mutually opposed in the front-rear direction across the axis of the spinning shaft 11.

In a middle in the up-down direction of the inner circumferential face of the inner circumferential wall 43*a*, two protrusions 47 protrude inward in the radial direction, which are mutually opposed in the right-left direction across the axis of the spinning shaft 11.

On a lower end face of the inner circumferential wall 43*a*, two uneven portions 45 are mutually opposed in the right-left direction across the axis of the spinning shaft 11 in which ridges are successively formed to mesh with the ribs 21.

On a top wall 43*b* that define the annular recess 42 of the body 40, arc slits 46 are formed so that the tongues 34 of the performance changing ring 30 can be inserted therein from the lower side. The arc slits 46 have a length that allows the tongues 34 to move sufficiently.

4. Identifier 60

An identifier 60 is attached in the round hole 41. The identifier 60 is used to identify the toy top 1 or the player thereof.

To achieve the identification, identifiers 60 with different patterns and/or colors are provided in the embodiment, and the player selects one identifier 60 therefrom and attach it to the round hole 41 with grooves 60*a* and the protrusions 47 that serve as screw threads.

Assembling Method

Next, the assembling method of the toy top 1 will be described. The shaft portion 10 has been already assembled. Further, the identifier 60 has been already attached in the round hole 41.

First, the shaft portion 10 is fitted in the performance changing ring 30 such that the protrusions 15 of the shaft portion 10 mate with the recesses 33 of the performance changing ring 30. Subsequently, the assembly is brought toward the body 40 from the lower side. In this step, the tongues 34 of the performance changing ring 30 of the assembly are aligned with predetermined ends of the arc slits 46 of the body 40 (see FIG. 3). In this engagement, the hooks 17 of the shaft portion 10 do not overlap the hooks 44 of the body 40 in the up-down direction. This engagement is referred to as an engagement releasable engagement. Thereafter, the shaft portion 10 of the assembly is pushed toward the body 40. Then the performance changing ring 30 firstly abuts the bottom face of the body 40. Then, the spring 20 is compressed, and the hooks 17 of the shaft portion 10 are relatively pushed up higher than the hooks 44 of the body 40. Subsequently, the shaft portion 10 together with the performance changing ring 30 is turned relative to the body 40 until the tongues 34 reach the other ends opposite to the predetermined ends. This is a relative turn of the body 40 and the performance changing ring 30 with respect to the shaft portion 10. Then, the hooks 17 of the shaft portion 10 are vertically aligned with the hooks 44 of the body 40 as illustrated in FIG. 5. When the hand is removed from the shaft portion 10, the lower face of the hooks 17 of the shaft portion 10 abuts the upper face of the hooks 44 of the body 40 by the action of the biasing force of the spring 20.

This engagement, in which the bottom faces of the hooks 17 of the shaft portion 10 are in contact with the upper faces of the hooks 44 of the body 40, is referred to as an engaged engagement. In this way, the shaft portion is coupled with the performance changing ring 30 and the body 40. The toy top 1 is thus assembled.

How to Change Spinning Characteristic

Next, a method to change the spinning characteristic when the additional part 54 is attached to the shaft portion 10 will be described referring to FIG. 7A to FIG. 7D.

When the projections 534 of the supporting part 53 are engaged with any pair of recesses 516 (e.g. recesses 516*a*), the supporting part 53 is biased upward by the coil spring 110 so that the projections 534 remain being fit in the recesses 516 and do not move in an ordinary engagement.

As described above, the recesses 516*a* are the deepest in the axis direction of the spinning shaft 11 in the embodiment. As illustrated in FIG. 7A, when the projections 534 of the supporting part 53 are engaged with the recesses 516*a*, the additional part 54 is at the highest attachment position in the axis direction, and the shaft tip 112 of the spinning shaft 11 protrudes the most from the hole 542 of the ring 541.

In this engagement, only the shaft tip 112 of the spinning shaft 11 contacts the ground when the toy top 1 spins vertically or almost vertically with respect to the ground surface. Only when the toy top 1 is largely inclined with respect to the ground surface, the ring 541 contacts the ground along with or instead of the shaft tip 112.

A user who wants to change the spinning characteristic of the toy top 1 temporarily pulls the adjusting member 52 downward (the direction indicated by the outlined arrow in FIG. 7B) as illustrated in FIG. 7B. Then, while pulling the adjusting member 52 down to the height at which the projections 534 can cross over the bumps 518 (518*a*) defining the recesses 516*a*, he/she turns the adjusting member 52 around the axis (to the right in FIG. 7A to FIG. 7D in the embodiment).

When the user releases his/her hand from the adjusting member 52 after he/she turns the adjusting member 52 until the projections 534 cross over the bumps 518 (518*a*) of the recesses 516*a* to reach another pair of recesses 516 (e.g. the recesses 516*b* next to the recesses 516*a* at the right in FIG. 7A to FIG. 7D), the adjusting member 52 including the supporting part 53 is pushed up by the biasing force (pushing force) of the coil spring 110 so that the projections 534 fit in the recesses 516*b* as illustrated in FIG. 7C.

When the protrusions 534 of the supporting part 53 are engaged with the recesses 516 as illustrated in FIG. 7C, the additional part 54 is at a slightly lower attachment position in the axis direction by the difference of depth of the recesses 516*b* since the recesses 516*b* are shallower in the axis direction of the spinning shaft 11 than the recesses 516*a*. Accordingly, the shaft tip 112 of the spinning shaft 11 protrudes slightly less from the hole 542 of the ring 541.

In this engagement, when the toy top 1 spins vertically or almost vertically with respect to the ground surface, only the shaft tip 112 of the spinning shaft 11 contacts the ground. However, when the toy top 1 is even slightly inclined with respect to the ground surface, the ring 541 contacts the ground along with or instead of the shaft tip 112.

The user can further temporarily pulls the adjusting member 52 downward (the direction indicated by the outlined arrow in FIG. 7B) as illustrated in FIG. 7B, turns the adjusting member 52 around the axis (to the right in FIG. 7A to FIG. 7D in the embodiment) until the projections 534 cross over the bumps 518 (518*b*) defining the recesses 516*b* to reach another pair of recesses 516 (e.g. recesses 516*c* next to the recesses 516*b* at the right in FIG. 7A to FIG. 7D), and releases his/her hand from the adjusting member 52. Then, the adjusting member 52 including the supporting part 53 is pulled up by the biasing force (pressing force) of the coil spring 110 so that the projections 534 fit in the recesses 516*c* as illustrated in FIG. 7D.

The recesses 516*c* is further deeper in the axis direction of the spinning shaft 11 than the recesses 516*b*. When the projections 534 are fitted in the recesses 516*c*, the additional part 54 is at a slightly lower attachment position in the axis direction by the difference of depth of the recesses 516*c* as illustrated in FIG. 7D. Accordingly, the shaft tip 112 of the spinning shaft 11 does not protrude from the hole 542 of the ring 541.

In this engagement, only the ring 541 contacts the ground regardless of the inclination of the spinning toy top 1.

When the user further wants to fit the projections 534 into another pair of recesses 516 other than the recesses 516*c*, he/she can turn the adjusting member 52 until the projections 534 cross over the bumps 518 (518*c*) defining the recesses 516*c* to reach the recesses 516*a* next to the recesses 516*c* at the right. Alternatively, the user can turn the adjusting member 52 in the opposite direction to the left until the projections 534 cross over the bump 518 (518*b*) defining the recesses 516*b* to return to the recesses 516*b* next to the recesses 516*c* at the left.

The toy top 1 spins stably when the shaft tip 112 having a small contact area contacts the ground. However, when the ring 541 having a large contact area contacts the ground, the action becomes irregular, such as an irregular change of the spinning angle and a large movement of the toy top 1. This can result in an unexpected attack or the like on an opponent toy top.

As illustrated in FIG. 7A to FIG. 7D, the embodiment illustrates an example in which an adjustment can be made by changing the position (type) of the recesses 516 that is engaged with the projections 534 of the adjusting member 52, in which the engagement can be selected from among three levels ranging from the engagement in which the shaft tip 112 of the spinning shaft 11 protrudes from the hole 542 of the ring 541 to the state in which the shaft tip 112 does not protrude from the hole 542 of the ring 541. However, the adjustable levels are not limited to the illustrated three levels.

For example, another pair of recesses 516 that is yet shallower than the recesses 516*c* in FIG. 7D may be provided so that the additional part 54 can be at a yet lower attachment position at which the lower end of the ring 541 is lower than the shaft tip 112 of the spinning shaft 11.

In this configuration, it is possible to change the height of the shaft portion 10 according to change of the attachment position of the additional part 54 (i.e. to increase the length of the shaft portion 10 compared to the state in which the shaft tip 112 of the spinning shaft 11 contacts the ground).

Next, a method to change the spinning characteristic when the additional part 57 is attached to the shaft portion 10 will be described referring to FIG. 9A to FIG. 9D.

In the case in which the additional part 57 is attached to the shaft portion 10, the additional part 57 is at the highest attachment position in the axis direction when the projections 534 of the supporting part 53 are engaged with the recesses 516*a* that are deepest in the axis direction of the spinning shaft 11. In this state, the shaft tip 112 of the spinning shaft 11 is in contact with an inner side of a lower end of the covering part 571 of the additional part 57 as illustrated in FIG. 9A, and the length of the shaft portion 10 of the toy top 1 is the shortest.

Figure 9B:
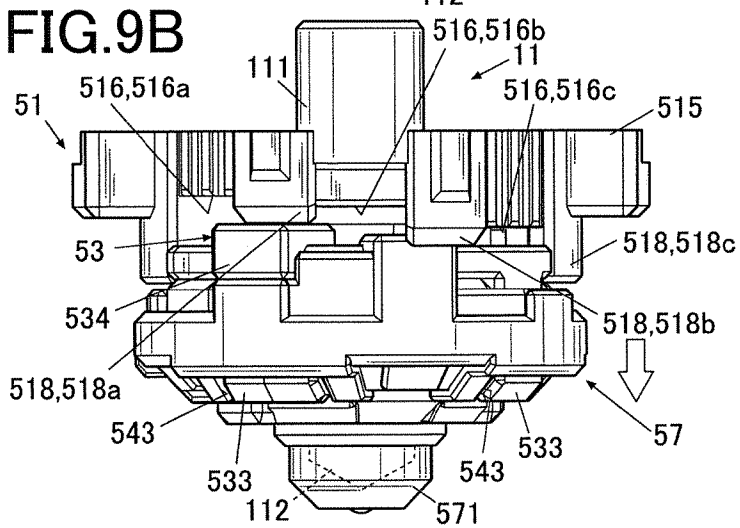

A user who wants to change the spinning characteristic of the toy top 1 temporarily pulls the adjusting member 52 downward (in the direction indicated by the outlined arrow in FIG. 9B) as illustrated in FIG. 9B. Then, while pulling the adjusting member 52 down to the height at which the projections 534 can cross over the bumps 518 (518*a*) defining the recesses 516*a*, he/she turns the adjusting member 52 around the axis (to the right in FIG. 9A to FIG. 9D in the embodiment).

Figure 9C:
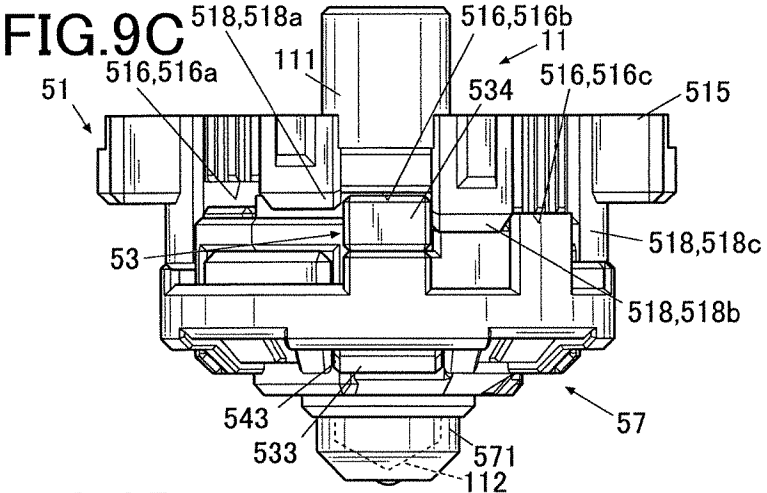

When the user releases his/her hand from the adjusting member 52 after he/she turns the adjusting member 52 until the projections 534 cross over the bumps 518 (518*a*) of the recesses 516*a* to reach another pair of recesses 516 (e.g. the recesses 516*b* next to the recesses 516*a* at the right in FIG. 9A to FIG. 9D), the adjusting member 52 including the supporting part 53 is pushed up by the biasing force (pushing force) of the coil spring 110 so that the projections 534 fit in the recesses 516*b* as illustrated in FIG. 9C.

Since the recesses 516*b* are shallower in the axis direction of the spinning shaft 11 than the recesses 516*a*, the additional part 54 is at a slightly lower attachment position in the axis direction by the difference of depth of the recesses 516*b* when the protrusions 534 of the supporting part 53 are engaged with the recesses 516*b* as illustrated in FIG. 9C. Accordingly, the lower end of the covering part 571 is at a slightly lower position than the shaft tip 112 of the spinning shaft 11.

In this state, the shaft portion 10 of the toy top 1 is longer, which changes the spinning characteristic of the toy top 1.

Figure 9D:
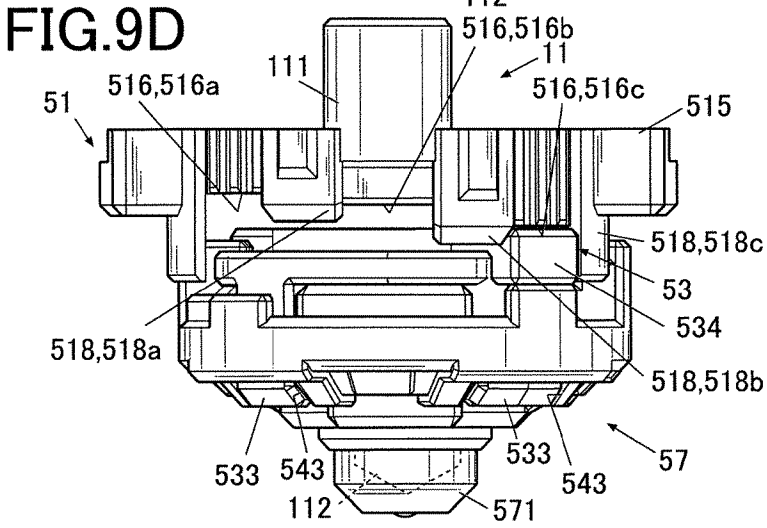

Further, when the user further performs the same process so that the protrusions 534 fit in the recesses 516*c*, the additional part 54 is at a lower attachment position in the axis direction by the difference of depth of the recesses 516*b* when the protrusions 534 of the supporting part 53 are engaged with the recesses 516*c* as illustrated in FIG. 9D, since the recesses 516*c* are the shallowest in the axis direction of the spinning shaft 11. Accordingly, the lower end of the covering part 571 is at a slightly lower position than the shaft tip 112 of the spinning shaft 11.

In this state, the shaft portion 10 of the toy top 1 is further longer.

When the length of the shaft portion 10 is changed, the spinning characteristic is also changed since the center of gravity of the toy top 1 is changed. This can result in an unexpected attack or the like on an opponent toy top.

Detaching Tool

The toy top 1 of the embodiment is provided with a detaching tool 70 for the additional parts 54, 57.

Figure 11:
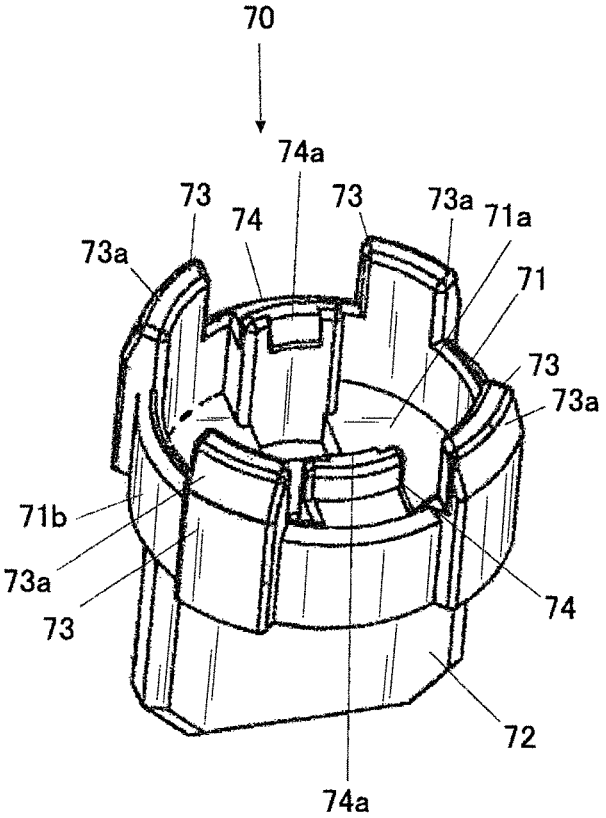
FIG. 11 is a perspective view of a detaching tool according to the embodiment.

As illustrated in FIG. 11, the detaching tool 70 includes a bottomed cylindrical base 71. On a bottom 71*a* of the base 71, a tongue-shaped tab 72 stands. At a cylindrical part 71*b* of the base 71, four pressers 73 having the same shape stand at predetermined intervals in the circumferential direction. The position of the four pressers 73 correspond to the four engaging holes 543 of the toy top 1.

The pressers 73 have inclined faces 73*a* at outer sides of respective tips, which are inclined toward a center of the detaching tool 70. When the additional part 54 or 57 is detached, the four pressers 73 are simultaneously inserted into the four engaging holes 543.

At the inner side of the cylindrical part 71*b* of the detaching tool 70, two holders 74 having the same shape stand at a different position from the four pressers 73. At respective tips of the holders 74, hooks 74*a* protrude toward the center of the detaching tool 70. When the additional part 54 or 57 is detached, the two holders 74 are simultaneously inserted into the two engaging holes 544. Holes inside the respective holders 74 are formed for molding the holders 74. formed for molding the holders 74.

Next, the function of the detaching tool 70 is described with FIG. 12A to FIG. 13C. FIG. 12A to FIG. 13C illustrate only a main part of the detaching structure. The detaching tool 70 is used for detaching the additional parts 54, 57. Since the additional parts 54, 57 have the same detaching structure, only the case in which the detaching tool 70 is used for detaching the additional part 54 will be described.

Figure 12A:
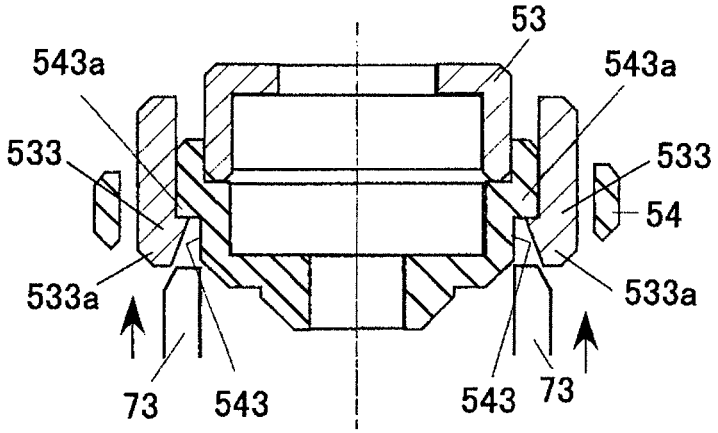
FIG. 12A to FIG. 12C are cross-sectional views illustrating the function of pressers of the detaching tool.
Figure 13A:
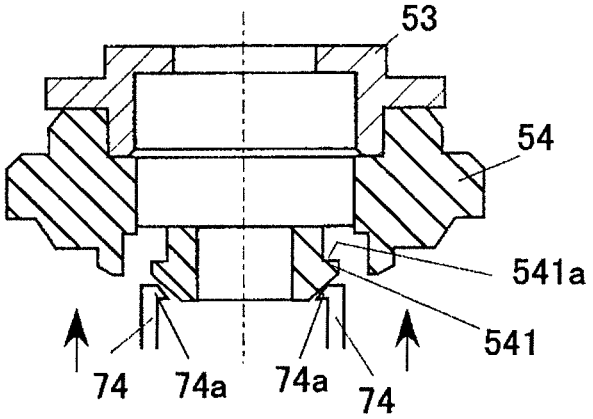
FIG. 13A to FIG. 13C are cross-sectional views illustrating the function of elastic holders of the detaching tool.
Figure 13B:
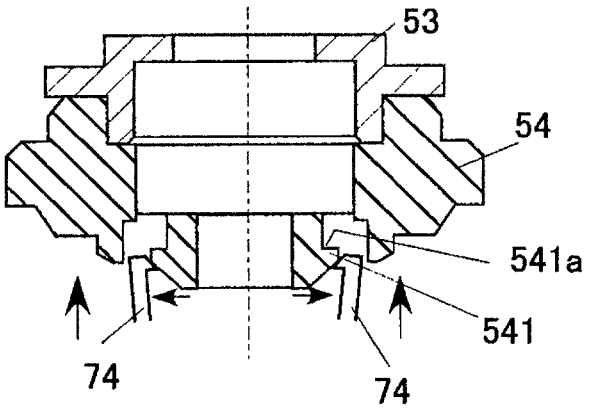

When the additional part 54 is detached, the detaching tool 70 is brought to the toy top 1 in a certain direction as illustrated in FIG. 12A and FIG. 13A, the four pressers 73 of the detaching tool 70 are simultaneously inserted into the hour engaging holes 543. Along with this, the two holders 74 are simultaneously inserted into the two engaging holes 544. The timing of insertion of the four pressers 73 into the four engaging holes 543 may be either the same as or different from the timing of insertion of the two elastic holders 74 into the two engaging holes 544. That is, when the additional part 54 is detached, it is only necessary that the two holders hold the additional part 54 while the engagement between the hooks 533*a* of the engaging legs 533 and the steps (receiving parts to be engaged) 543*a* is released, so that the additional part 54 is detachable.

Figure 12B:
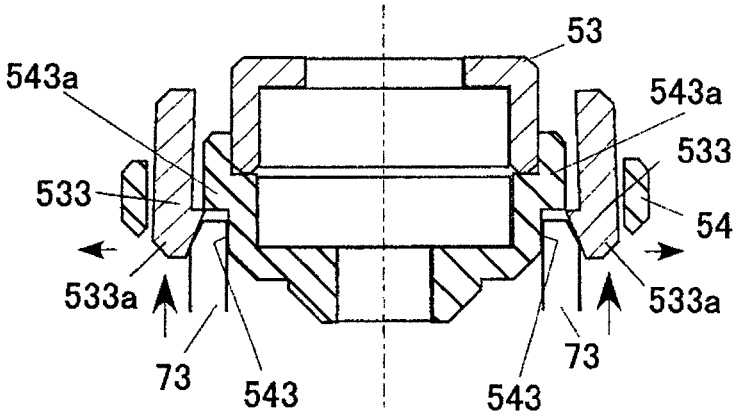
Figure 12C:
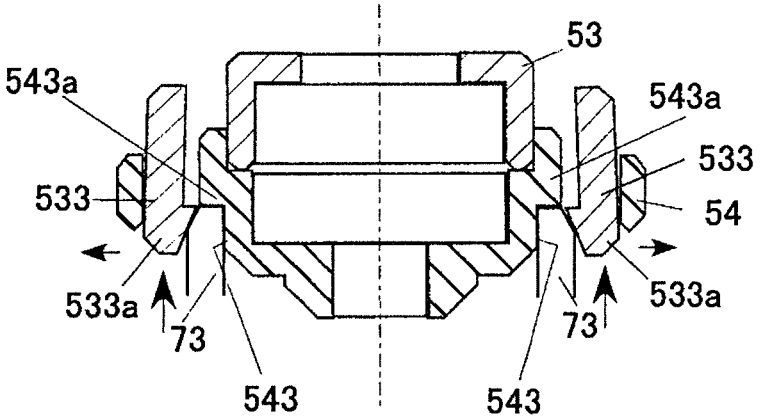

In the embodiment, the pressers 73 are guided by walls of the engaging holes 543 to abut hook tips of the engaging legs (elastic engaging hooks) 533. Then, the pressers 73 press the engaging legs 533 outward in the radial direction of the toy top 1. This elastically deforms the engaging legs 533 so that the engagement between the hooks 533*a* of the engaging legs 533 and the steps (receiving parts to be engaged) 543*a* is released (FIG. 12B). The engagement is released just before the four pressers 73 are inserted to the deepest position, and the engagement releasing state was thereafter retained (FIG. 12C).

Figure 13C:
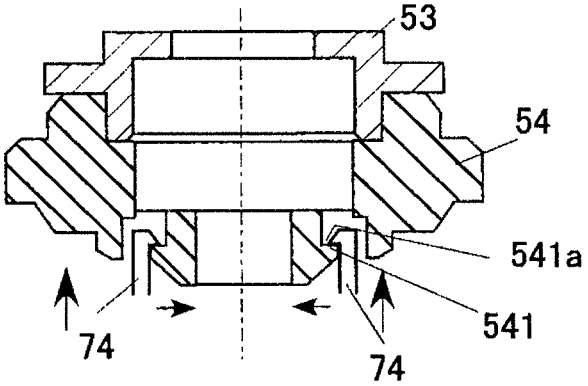

As for the holders 74, when the detaching tool 70 is brought to the toy top 1, the hook tips of the holders 74 firstly come in contact with a tapered part of the ring 541 (FIG. 13A). When the detaching tool 70 is further brought to the toy top 1, the holders 74 are elastically bent (FIG. 13B) to eventually cross over the largest part of the ring 541 and then return to the original shape. The hooks 74*a* of the holders 74 are thus engaged with receiving parts 541 at the back side of the ring 541 (FIG. 13C). In this state, the engagement between the hooks 533*a* of the engaging legs 533 and the steps 543*a* is released as described above.

When the detaching tool 70 is moved away from the main body of the toy top 1 in this state, the additional part 54 is also moved away from the toy top 1 integrally with the detaching tool 70 since the hooks 74*a* of the holders 74 are engaged with the receiving parts 541*a* at the back side of the ring 541 while the hooks 533*a* of the engaging legs 533 and the steps 543*a* are in an engagement released state. While the hooks 533*a* of the engaging legs 533 and the steps 543*a* are in an engagement released state, the steps 543*a* of the additional part 54 override the hook tips of the engaging legs 533. In this way, the detaching tool 70 and the additional part 54 can be detached from the main body of the toy top 1. Then, the detaching tool 70 and the additional part 54 detached from the main body of the toy top 1 are separated from each other.

Detaching the additional parts 54, 57 with the detaching tool 70 in this way has the following advantageous effects.

That is, it is possible to detach the additional parts 54, 57 only by bringing the detaching tool 70 to the main body of the toy top 1 and then moving it away.

Further, since the additional parts 54, 57 are held by hooks 74*a* of the two or more elastic holders 74 during the detachment, it is possible to detach the additional parts 54, 57 more readily.

Even when only a single elastic holder 74 is provided, it is possible to detach the additional parts 54, 57. However, it is preferred that a plurality of elastic holders 74 is provided so that the additional parts 54, 57 are held more reliably by the elastic holders 74.

Figure 14A:
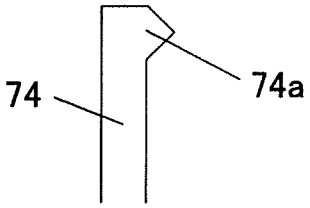
FIG. 14A to FIG. 14C are variations of the elastic holders.
Figure 14B:
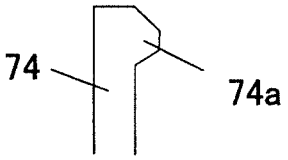
Figure 14C:
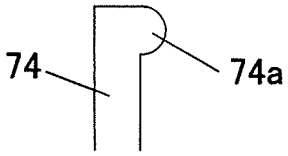

In the embodiment, the hooks 74*a* of the holders 74 of the detaching tool 70 has the function of pulling the additional parts 54, 57 apart from the main body of the toy top 1. However, since the hooks 533*a* of the engaging legs 533 or the like and the steps 543*a* are in the engagement released state when the additional parts 54, 57 start to be detached, it is not necessary that the hooks 74*a* of the holders 74 be engaged with the receiving part 541*a* at the back side of the ring 541 or the like as firmly as the engagement between the elastic engaging hooks 73 and the steps 543*a* and the like. That is, the hooks 74*a* of the elastic holders 74 may be reduced to such a size that is smaller than the hooks of the engaging legs 533 but can pull the additional part 54 apart. Further, the hook tips of the holders 74 may be formed in an isosceles triangular, trapezoidal or semicircular shape in a side view (FIG. 14A to FIG. 14C) so that the hook tips lightly engage with the receiving parts 541*a*. This enables readily separating the detaching tool 70 from the additional parts 54, 57 that have been detached from the main body of the toy top 1. Instead of the elastic engaging hooks, elastic bar members with no hook may be provided to elastically come in pressure contact with a part of the additional parts 54, 57. In this case, it is preferred that a plurality of elastic bar members is provided to hold a part of the additional parts 54, 57 therebetween. Further, a spring may be provided to bias the hooks so that the additional parts 54, 57 are held.

The detaching tool 70 may be used for not only the toy top 1 but also general toys and the like having an attaching structure using an elastic engaging hook.

How to Play

Next, an example of how to play the toy top 1 will be described.

In this example, a player spins a toy top 1 and forces it to battle with an opponent toy top 1.

Figure 10:
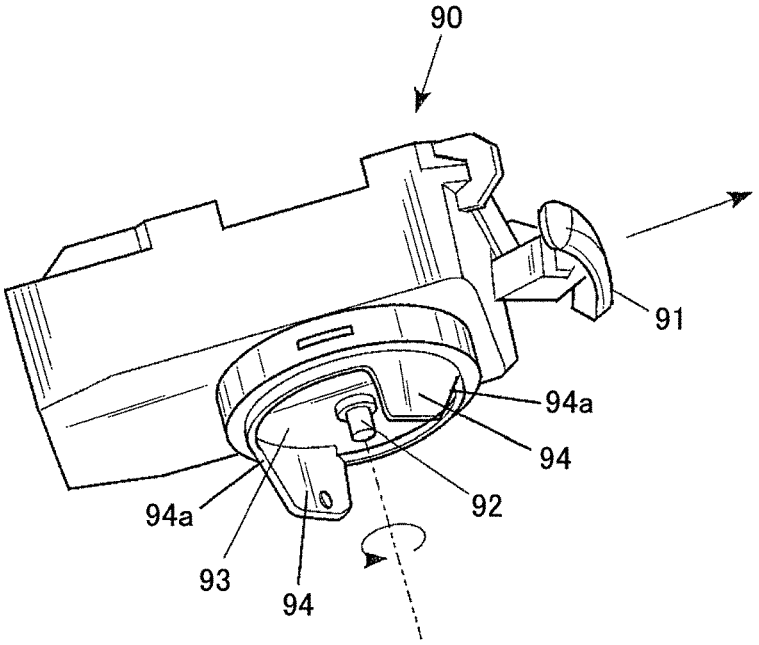
FIG. 10 is a perspective view of an example of a launcher for spinning the toy top of the embodiment.

In such cases, the launcher 90 as illustrated in FIG. is used to apply a spinning force to the toy top 1. The launcher 90 includes a disk (not shown) therein that is biased in a certain spinning direction by a spiral spring (not shown). The launcher 90 is configured such that when an operating member, such as a string or rack of teeth (not shown) is pulled by a handle 91 while a spiral spring (not shown) biases the disk in a certain rotational direction, the disk is rotated, and a top holder 93 is rotated accordingly. The rotation of the top holder 93 is transmitted to the toy top 1 through a fork 94 that protrudes downward, so that the toy top 1 is rotated. When the fork 94 is inserted in the arc slits 46 (see FIG. 3) of the body 90, and when the handle 91 of the launcher 90 is completely pulled out of the launcher 90, the disk and the top holder 93 stop rotating while the toy top 1 continues rotating by the action of its inertial force. As a result, the toy top 1 descends from the top holder 93 following the inclined faces 94*a* of the fork 94. In FIG. 10, the reference sign 92 designates a rod that is retractable into the top holder 93. When the toy top 1 is set to the top holder 93, the rod 92 is pushed by an upper face of the toy top 1 and retracted into the top holder 93. For example, the rod 92 is used to detect attachment/detachment of the toy top 1.

The toy top 1 thus launched spins in a predetermined battle field. When the toy top 1 collides with an opponent toy top 1, the impact or friction of the collision produces a force that acts on the body 40 in the direction opposite to the spinning direction of the shaft portion 10 and the performance changing ring 30, and the body 40 thereby relatively turns in the direction opposite to the spinning direction of the shaft portion 10 and the performance changing ring 30.

Then, the ribs 21 mesh with the uneven portions 45 of the body 40. Since the biasing force of the spring 20 acts on the ribs 21, every time an impact force of a collision is applied, the body 40 turns relative to the shaft portion 10 to change the mesh position. When the ribs 21 eventually reach the engagement releasing position, the hooks 44 of the body 40 are released from the hooks 17 of the shaft portion 10 so that the body 40 separates from the shaft portion 10 by the biasing force of the spring 20 that acts on the ridges 21. As a result, the toy top 1 is disassembled as illustrated in the right side of FIG. 1.

Advantageous Effects of the Embodiment

As described above, the toy top 1 according to the embodiment includes: the shaft portion 10; the additional part 54 which is attached to the shaft portion 10 movably in the axis direction of the spinning shaft 11 of the shaft portion 10; and an engaging part (the recesses 516 and the protrusions 534 in the embodiment) which engages the additional part 54 with the spinning shaft 11 at different positions in the axis direction, wherein the attachment position of the additional part 54 is changeable by changing the engagement of the additional part 54 by the engaging part (recesses 516 and projections 534).

This enables readily switching the configuration of the grounding part of the toy top 1 between multiple levels to change the center of gravity or the spinning characteristic of the toy top 1. Therefore, it is possible to enjoy various attacks and battle games that are rich in variation with the same toy top 1.

In the embodiment, the additional part 54 is detachable from the shaft portion 10. Therefore, different additional parts (the additional parts 54, 57 in the embodiment) can be provided so that a user can select a suitable additional part for a desired spinning characteristic. Since it is possible to replace the additional part with another additional part having a different function (e.g. the additional part 54 that can change the grounding state of the bottom tip of the shaft portion 10 according to the attachment position, and the additional part 57 that can change the height (length) of the shaft portion 10 according to the attachment position), it is possible to modify the same toy top 1 into various toy tops that can perform different characteristic attacks, i.e. to make a wide variation of modifications, in a simple process. Therefore, a toy top that can perform various attacks on an opponent toy top can be achieved.

Further, the additional parts 54, 57 may be separately provided as consumable parts. For example, when the additional part 54 or 57 is broken by a collision with an opponent toy top or the like, it is possible to remove only the broken additional part 54 or 57 to replace it with a new one. Therefore, the toy top 1 can be used for a long time.

In the embodiment, the degree of protrusion of the shaft tip 112 of the spinning shaft 11 is adjustable only by changing the attachment position of the additional part 54. Therefore, it is possible to readily switch the grounding pattern according to the degree of protrusion of the bottom tip of the spinning shaft between (i) the state in which only the shaft tip 112 of the spinning shaft 11 contacts the ground, (ii) the state in which both the shaft tip 112 of the spinning shaft 11 and the ring 541 contact the ground, and (iii) the state in which only the ring 541 contacts the ground.

Since the ground contact area changes according to the part that contacts the ground, it is possible to change the spinning characteristic of the toy top 1 so as to perform various attacks on an opponent toy top.

In the embodiment, the additional part 57 includes the covering part 571 that forms a new spinning shaft. This enables readily changing the height of the shaft portion 10 only by changing the attachment position of the additional part 57.

Changing the height of the shaft portion 10 can change the center of gravity of the toy top 1 accordingly. Therefore, the toy top 1 that can perform various attacks on an opponent toy top can be achieved.

In the embodiment, the engaging part for changing the attachment position of the additional part 54 is constituted by the recesses 516 and the protrusions 534 that fit in the recesses 516.

This enables readily changing the attachment position of the additional part 54 only by changing the fitting position between the recesses 516 and the protrusions 534 so as to change the spinning characteristic of the toy top 1. Therefore, everyone can readily enjoy battle games that are rich in variation.

Further, since the engagement is established by meshing the recesses 516 with the protrusions 634, the position in the axis direction of the additional part 54 relative to the spinning shaft 11 is not changed even when the toy top 1 spins or vigorously collides with an opponent toy top, and the configuration preset by a user before starting a game can be maintained.

In the embodiment, the recesses 516 are formed in the step forming member 51 of the shaft portion 10 around the spinning shaft 11 at different positions in the axis direction, and the protrusions 534 that can selectively fit in any pair of the recesses 516 are formed in the supporting part 53 of the adjusting member 52.

This enables readily changing the attachment position of the additional part 54 by shifting the adjusting member 52 around the spinning shaft 11. Therefore, everyone can readily enjoy battle games that are rich in variation.

In the embodiment, the toy top 1 includes a coil spring 110 as a biasing member which applies a biasing force to maintain the engagement of the additional part 54.

This can prevent the additional part 54 from being deviated from the attachment position or being released from the engagement even when the toy top 1 collides with another toy top during a game.

Alternate Embodiments of the Invention

While an embodiment of the present invention is described, the present invention is not limited to the above-described embodiment, and it should be understood well that various changes can be made without departing from the features of the present invention.

For example, the embodiment illustrates an example in which the engaging part is composed of recesses 516 that are formed in the outer part 515 of the step forming member 51 and the protrusions 534 of the supporting part to be fitted therein. However, the engaging part is not limited to the recesses 516 and the protrusions 534 but may be constituted by any part that allows changing the attachment position in the axis direction of the additional part 54.

For example, screw threads that can mutually fit may be formed respectively in an outer circumferential face of the shaft portion 10 and an inter circumferential face of the additional part 54 or 57 (or the adjusting member 52 including the additional part), and the additional part 54 or 57 (or the adjusting member including the additional part) may be screwed around the shaft portion 10. In this configuration, the engagement position in the axis direction of the adjusting member 52 including the additional part 54 or 57 can be gradually changed according to the screwed position (degree of being screwed).

Further, instead of the recesses, the changeable engagement position of the engaging part can be achieved only by abutment of the additional part 54 or 57, e.g. by a stepped part or the like.

The embodiment illustrates an example in which the adjusting member 52 including the additional part 54 is turned with respect to the shaft portion 10 so that the protrusions 534 fit in the recesses 516 (engaging part). However, the method to switch the engaging part may not be turning the adjusting member 52.

Further, the engaging part is not limited to the combination of the recesses 516 of the shaft portion 10 and the protrusions 534 of the adjusting member 52 including the additional part 54. For example, a protrusion may be formed in the shaft portion 10 while recesses may be formed in the adjusting member 52 including the additional part 54 in contrast to the embodiment.

The engaging part may not have the configuration of fitting a protrusion in recesses. For example, the adjusting member 52 including the additional part 54 or 57 may be engaged with the shaft portion 10 by hooking a hook or the like to a recess or a hole.

Alternatively, for example, stepped protrusions may formed at different heights around the outer circumference of the shaft portion 10, and the adjusting member 52 including the additional part 54 or 57 may be pressed against the protrusions by a biasing force of a biasing member such as a spring.

In the embodiment, the supporting part 53 that moves integrally with the additional part 54 or 57 is provided in addition to the additional part 54 or 57, and the attachment position in the axis direction is changeable by changing engagement of the adjusting member 52 composed of the additional parts 54 or 57 and the supporting part 53 with the shaft portion 10. However, the engaging part may not be formed in the step forming member 51 and the supporting part 53, and the supporting part 53 is not an essential component.

It is only necessary that the engaging part be formed in the shaft portion 10 and the additional part 54 or 57 or the like that is movable in the axis direction of the spinning shaft 11. For example, a protrusion or the like may be formed in the additional part 54 or 57 as the engaging part that engages with the engaging part (e.g. recesses) of the shaft portion 10.

The entire disclosure of Japanese patent application No. 2017-201196, filed on Oct. 17, 2017, is incorporated herein by reference in its entirety.

What is claimed is:

1. A detachable structure, comprising:

a toy top having a first part, a second part removably connected to the first part, and a spinning shaft received by the first and second parts; and a detaching tool having a pair of pressers and a pair of elastic holders, wherein the first part has a pair of elastic engaging hooks that are mutually opposed across the spinning shaft, wherein the second part has— a ring, a first pair of engaging holes that are mutually opposed across the ring and correspond to the pair of elastic engaging hooks of the first part and to the pair of pressers of the detaching tool, and a second pair of engaging holes that are mutually opposed across the ring and correspond to the pair of elastic holders of the detaching tool, wherein the pair of elastic engaging hooks are respectively inserted into and removably engaged with the first pair of engaging holes of the second part, wherein, when the pair of pressers of the detaching tool are respectively inserted into the first pair of engaging holes of the second part, the pair of pressers release engagement between the elastic engaging hooks and the first pair of engaging holes and, at the same time, the elastic holders of the detaching tool hold the ring of the second part, and wherein, when the detaching tool is then withdrawn, the elastic holders hold the second part via the second pair of engaging holes to detach the second part from the first part.

2. The detachable structure according to claim 1, wherein the pair of elastic engaging hooks is two pairs of elastic engaging hooks mutually opposed across the spinning shaft at substantially equal intervals, the first pair of engaging holes is two pair of engaging holes that are disposed around the ring at substantially equal intervals, and the pair of pressers is two pair of pressers that are disposed corresponding to the two pairs of elastic engaging hooks.

3. The detachable structure according to claim 1, wherein a step is formed in each of the first pair of engaging holes of the second part to engage with the pair of elastic engaging hooks.

4. The detachable structure of the toy according to claim 1, wherein the ring of the second part includes an outer diameter, and the pair of elastic holders include hooks and surround and hold the outer diameter of the ring of the second part when the second part is detached from the first part.

* * * * *